US011118825B2

(12) United States Patent
Kondou et al.

(10) Patent No.: US 11,118,825 B2
(45) Date of Patent: Sep. 14, 2021

(54) ICE MAKING SYSTEM

(71) Applicant: DAIKIN INDUSTRIES, LTD., Osaka (JP)

(72) Inventors: Azuma Kondou, Osaka (JP); Shouhei Yasuda, Osaka (JP); Takahito Nakayama, Osaka (JP); Kazuyoshi Nomura, Osaka (JP); Takeo Ueno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/961,770

(22) PCT Filed: Dec. 12, 2018

(86) PCT No.: PCT/JP2018/045635
§ 371 (c)(1),
(2) Date: Jul. 13, 2020

(87) PCT Pub. No.: WO2019/138765
PCT Pub. Date: Jul. 18, 2019

(65) Prior Publication Data

US 2020/0386463 A1 Dec. 10, 2020

(30) Foreign Application Priority Data

Jan. 15, 2018 (JP) ..... JP2018-003933

(51) Int. Cl.
*F25C 5/12* (2006.01)
*F25C 5/10* (2006.01)

(52) U.S. Cl.
CPC . *F25C 5/12* (2013.01); *F25C 5/10* (2013.01)

(58) Field of Classification Search
CPC ..... F25C 5/12; F25C 5/10; F25C 1/00; F25C 1/145; F25C 2700/08; F25C 2600/04;
(Continued)

(56) References Cited

U.S. PATENT DOCUMENTS 1,930,570 A * 10/1933 Taylor ..... F25C 1/145 62/106
2,034,213 A * 3/1936 Smith ..... A23G 9/12 62/342

(Continued)

FOREIGN PATENT DOCUMENTS

JP 3-177767 A 8/1991
JP 03177767 A * 8/1991

(Continued)

OTHER PUBLICATIONS

International Preliminary Report of corresponding PCT Application No. PCT/JP2018/045635 dated Jul. 30, 2020.

(Continued)

*Primary Examiner* — Len Tran
*Assistant Examiner* — Kirstin U Oswald
(74) *Attorney, Agent, or Firm* — Global IP Counselors, LLP

(57) ABSTRACT an ice making system includes a tank that stores a medium to be cooled, an ice making machine that cools the medium and makes ice, a pump that circulates the medium between the tank and the ice making machine, a de-icing mechanism that heats the medium and melts the ice in the ice making machine, and a control device that controls operations of the ice making machine, the pump, and the de-icing mechanism. The ice making machine includes a cooling chamber that cools the medium, an inflow port through which the medium flows into the cooling chamber, and a discharge port through which the medium is discharged from the cooling chamber. The control device activates the de-icing mechanism when a pressure difference between a pressure of the medium at the inflow port and a pressure of the medium at the discharge port exceeds a predetermined value.

12 Claims, 8 Drawing Sheets

(58) Field of Classification Search
CPC ..... F25C 2500/08; F25C 2600/02; F25C 2301/002; F25B 13/00; F25B 2700/11; F25B 47/025; F25B 47/022; F25D 21/06; F25D 21/02; F25D 21/002
USPC ..... 62/138
See application file for complete search history.

(56) References Cited

U.S. PATENT DOCUMENTS 3,274,792 A * 9/1966 Weil ..... F25C 1/145 62/138
3,280,579 A * 10/1966 Kayl ..... F25D 21/002 62/156
3,369,376 A * 2/1968 Kious ..... F25C 1/00 62/344
4,075,863 A * 2/1978 Wilson ..... F25C 1/06 62/138
4,455,843 A * 6/1984 Quarles ..... F25C 5/10 62/138
4,510,761 A * 4/1985 Quarles ..... F25C 5/10 417/118
4,517,806 A * 5/1985 Korzonas ..... B01D 9/04 62/123
4,843,830 A * 7/1989 Haul ..... B67D 1/0864 62/59
5,083,438 A * 1/1992 McMullin ..... G01L 3/26 165/11.1
5,158,506 A * 10/1992 Kusano ..... A23G 9/163 62/136
5,203,176 A * 4/1993 De Weered ..... F25C 1/12 62/138
5,735,136 A * 4/1998 Howe ..... F25C 1/145 165/169
6,666,042 B1 * 12/2003 Cline ..... F24F 3/065 62/175
2008/0276629 A1 * 11/2008 Yamamoto ..... F25C 1/145 62/71
2014/0127365 A1 * 5/2014 Batmaz ..... A23B 7/0408 426/231

FOREIGN PATENT DOCUMENTS

JP 7-55301 A 3/1995
JP 9-273780 A 10/1997
JP 2000-205711 A 7/2000
JP 2003-185285 A 7/2003
JP 2003185285 A * 7/2003
JP 2011-85388 A 4/2011
JP 2011085388 A * 4/2011
WO 2017/221025 A1 12/2017

OTHER PUBLICATIONS

International Search Report of corresponding PCT Application No. PCT/JP2018/45635 dated Mar. 12, 2019.
European Search Report of corresponding EP Application No. 18 89 9670.6 dated Feb. 8, 2021.

* cited by examiner

ICE MAKING SYSTEM

CROSS-REFERENCE TO RELATED APPLICATIONS

This U.S. National stage application claims priority under 35 U.S.C. § 119(a) to Japanese Patent Application No. 2018-003933, filed in Japan on Jan. 15, 2018, the entire contents of which are hereby incorporated herein by reference.

BACKGROUND

Field of the Invention

The present disclosure relates to an ice making system.

Background Information

Japanese Unexamined Patent Publication No. 2003-185285 discloses an ice making refrigeration apparatus including a double-pipe flooded evaporator having an inner pipe through which a medium to be cooled flows, and an outer pipe containing the inner pipe. This ice making refrigeration apparatus expands, with an expansion mechanism, high-pressure liquid refrigerant flowing out of a condenser to reduce the pressure of the refrigerant, and supplies the low-pressure liquid refrigerant into an outer cooling chamber provided between the inner pipe and the outer pipe of the flooded evaporator. As a result, the medium to be cooled flowing through the inner pipe is cooled, while the liquid refrigerant in the outer cooling chamber evaporates. The medium to be cooled in the inner pipe turns into slurry ice after a subcooled state of the medium is undone by a rotary blade. The low-pressure refrigerant that has evaporated in the outer cooling chamber is discharged from the flooded evaporator and returned to a suction side of a compressor.

SUMMARY

In this type of ice making refrigeration apparatus, a phenomenon in which the flow of seawater in the inner pipe is interrupted and ice slurry is accumulated in the inner pipe (this phenomenon is also referred to as "ice accumulation") may occur. Such a phenomenon makes it difficult to continuously operate an ice making machine. However, no countermeasures have been taken against such a phenomenon in the ice making refrigeration apparatus described in Japanese Unexamined Patent Publication No. 2003-185285.

An object of the present disclosure is to provide an ice making system that can eliminate, at an early stage, ice accumulation that has occurred in an ice making machine.

(1) an ice making system of the present disclosure includes a tank that stores a medium to be cooled, an ice making machine that cools the medium to be cooled and makes ice, a pump that circulates the medium to be cooled between the tank and the ice making machine, a de-icing mechanism that performs a de-icing operation of heating the medium to be cooled and melting the ice in the ice making machine, and a control device, or controller, that controls operations of the ice making machine, the pump, and the de-icing mechanism, in which the ice making machine includes a cooling chamber that cools the medium to be cooled, an inflow port through which the medium to be cooled flows into the cooling chamber, and a discharge port through which the medium to be cooled is discharged from the cooling chamber, and the control device activates the de-icing mechanism when a pressure difference between a pressure of the medium to be cooled at the inflow port and a pressure of the medium to be cooled at the discharge port exceeds a predetermined value.

This configuration makes it possible to detect that the ice accumulation has occurred in the ice making machine and to perform the de-icing operation.

(2) The ice making machine preferably includes an inflow pressure sensor that detects a pressure of the medium to be cooled at the inflow port, and a discharge pressure sensor that detects a pressure of the medium to be cooled at the discharge port, and the control device calculates a difference between the pressure detected by the inflow pressure sensor and the pressure detected by the discharge pressure sensor, and compares the pressure difference with the predetermined value.

With such a configuration, the de-icing mechanism can be activated based on the pressure difference between the pressure of the medium to be cooled at the inflow port and the pressure of the medium to be cooled at the discharge port.

(3) The control device preferably stops the pump during the de-icing operation.

This configuration can suppress the melting of the ice in the tank, which is caused by a temperature rise in the tank.

(4) The ice making machine preferably includes a blade mechanism that rotates in the cooling chamber to disperse ice, and a detector that detects a locked state of the blade mechanism, and the control device stops the blade mechanism when the detector detects the locked state of the blade mechanism during the de-icing operation.

This configuration can suppress, for example, damage to the blade mechanism. When the blade mechanism is not in the locked state, the de-icing can be promoted by activating the blade mechanism during the de-icing operation.

(5) The ice making system preferably further includes a refrigerant circuit that is formed by connecting, with a refrigerant pipe, a compressor, a heat source-side heat exchanger, an expansion mechanism, and a utilization-side heat exchanger in that order, in which the utilization-side heat exchanger exchanges heat with the medium to be cooled in the cooling chamber in the ice making machine to evaporate refrigerant during an ice making operation, and the de-icing mechanism includes the refrigerant circuit and a four-way switching valve connected to a discharge side of the compressor in the refrigerant circuit, the four-way switching valve being configured to switch the ice making operation to the de-icing operation by switching a flow path of refrigerant discharged from the compressor, from a path leading to the heat source-side heat exchanger to a path leading to the utilization-side heat exchanger.

This configuration makes it possible to perform the de-icing operation using the refrigerant circuit in which the ice making machine makes ice.

(6) The control device preferably stops the de-icing operation when time required for ice crystals in the tank to rise to a height at which the ice crystals in the tank are not discharged toward the ice making machine has elapsed by activation of the pump.

With such a configuration, when the ice making system returns from the de-icing operation to the ice making operation, the ice crystals in the tank are not sent to the ice making machine, and it is possible to suppress the recurrence of the ice accumulation in the ice making machine.

DETAILED DESCRIPTION OF EMBODIMENT(S)

Embodiments of an ice making system will be described in detail below with reference to the accompanying drawings. Note that the present disclosure is not limited to the following examples, but is indicated by the appended claims and is intended to include all modifications within the scope and meaning equivalent to those of the claims.

First Embodiment

<Overall Configuration of Ice Making System>

Figure 1:
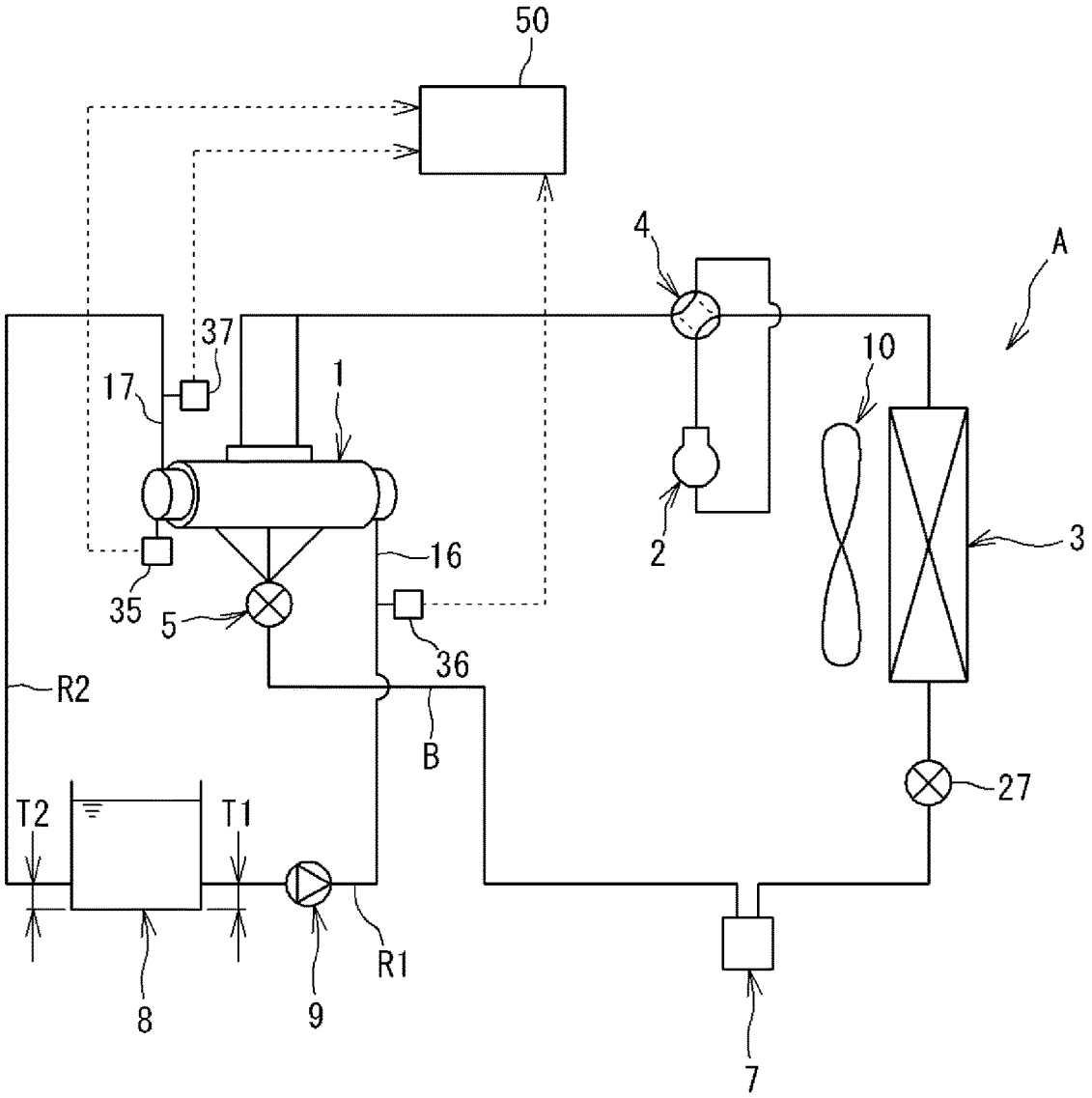
FIG. 1 is a schematic configuration diagram of an ice making system according to a first embodiment.

FIG. 1 is a schematic configuration diagram of an ice making system A according to a first embodiment.

In the ice making system A of the present embodiment, an ice making machine 1 continuously generates ice slurry using, as a raw material, seawater stored in a seawater tank 8 and stores the generated ice slurry in the seawater tank 8.

The ice slurry refers to sherbet-like ice in which fine ice is mixed with water or an aqueous solution. The ice slurry is also referred to as icy slurry, slurry ice, slush ice, or liquid ice.

The ice making system A of the present embodiment can continuously generate seawater-based ice slurry. Therefore, the ice making system A of the present embodiment is installed in, for example, a fishing boat or a fishing port, and the ice slurry stored in the seawater tank 8 is used for keeping fresh fish cool or the like.

The ice making system A of the present embodiment switches operations between an ice making operation of making ice in the ice making machine 1 and a de-icing operation of melting the ice stored in the ice making machine 1.

The ice making system A uses seawater as a medium to be cooled (object to be cooled). The ice making system A includes the ice making machine 1, a compressor 2, a heat source-side heat exchanger 3, a four-way switching valve 4, a utilization-side expansion valve (expansion mechanism) 5, a receiver (liquid receiver) 7, a heat source-side expansion valve (expansion mechanism) 27, a fan 10, the seawater tank (ice storage tank) 8, a pump 9, and the like. The ice making system A also includes a control device 50.

The compressor 2, the heat source-side heat exchanger 3, the heat source-side expansion valve 27, the receiver 7, the utilization-side expansion valve 5, and the ice making machine 1 are connected in that order by a refrigerant pipe to configure a refrigerant circuit.

The ice making machine 1, the seawater tank 8, and the pump 9 are connected by a seawater pipe to configure a circulation circuit.

The four-way switching valve 4 is connected to a discharge side of the compressor 2. The four-way switching valve 4 has a function of switching the direction of refrigerant discharged from the compressor 2 either toward the heat source-side heat exchanger 3 or toward the ice making machine 1. The four-way switching valve 4 switches operations between the ice making operation and the de-icing operation.

The compressor 2 compresses the refrigerant and circulates the refrigerant in the refrigerant circuit. The compressor 2 is of a variable displacement type (variable capacity type). Specifically, the compressor 2 can change the number of rotations of a built-in motor stepwise or continuously by controlling the motor with an inverter.

The fan 10 cools the heat source-side heat exchanger 3 with air. The fan 10 includes a motor, the number of rotations of which is changed stepwise or continuously through inverter control.

The utilization-side expansion valve 5 and the heat source-side expansion valve 27 are each configured by, for example, an electronic expansion valve that is driven by a pulse motor, and have an adjustable opening degree.

Figure 2:
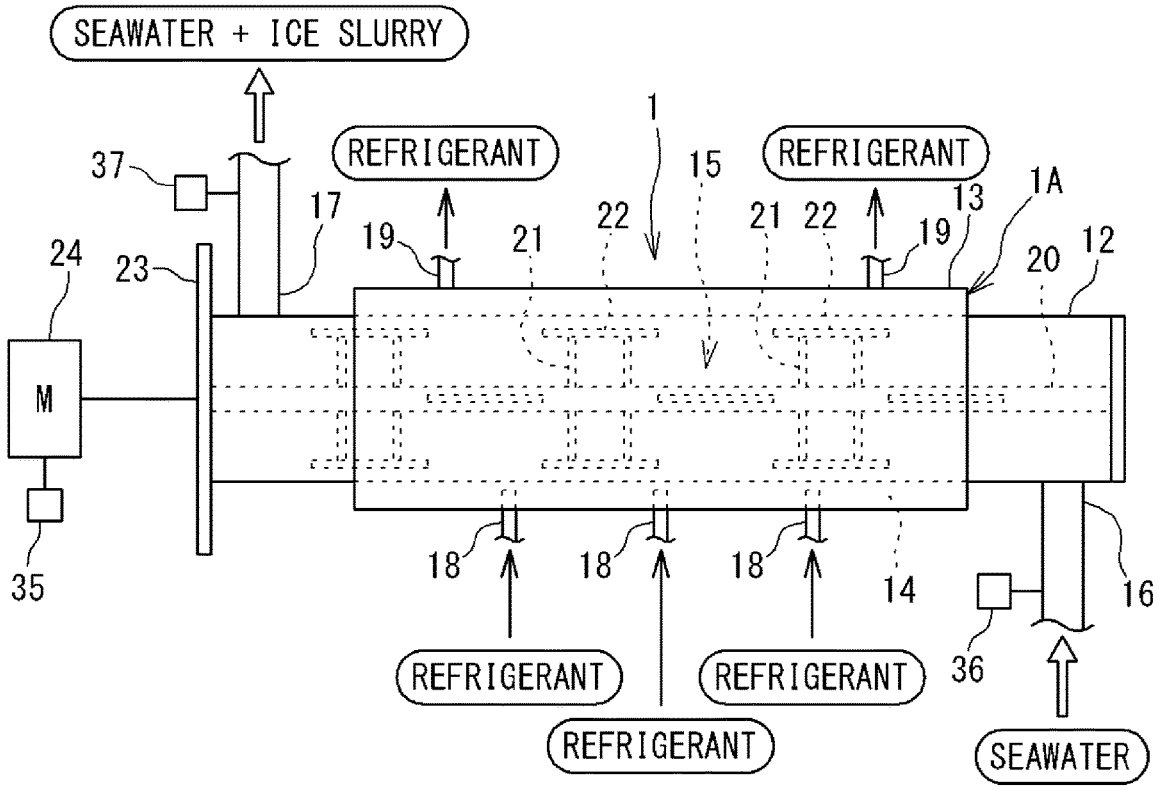
FIG. 2 is an explanatory side view of an ice making machine.
Figure 3:
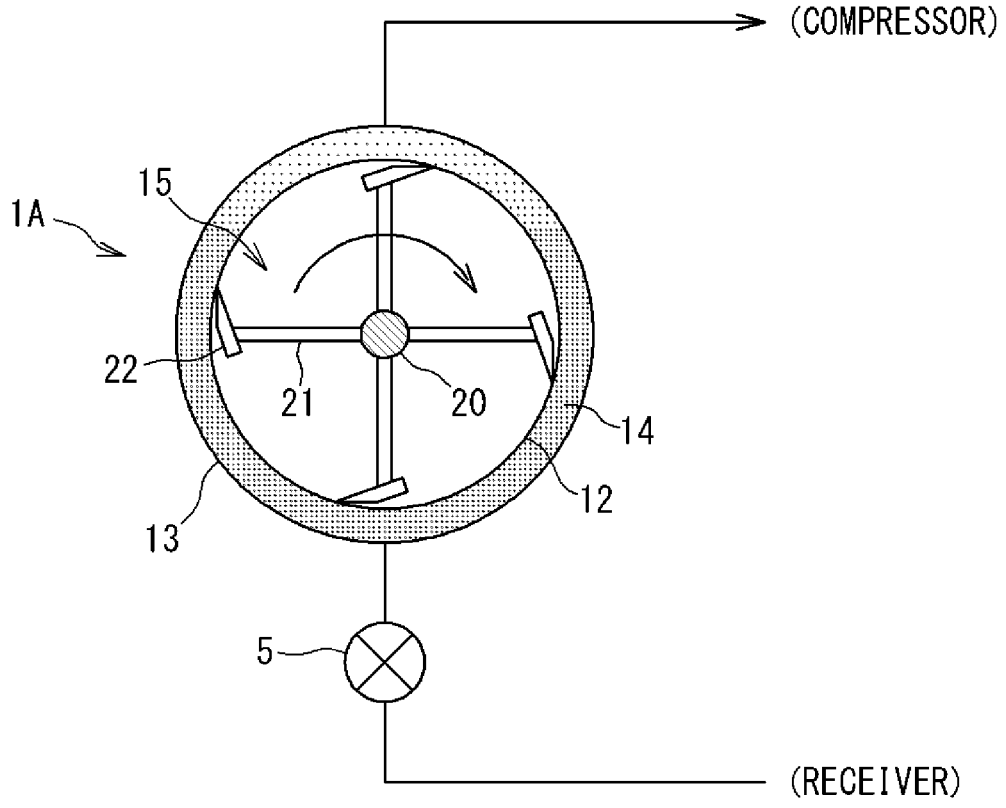
FIG. 3 is an explanatory view schematically showing a cross section of the ice making machine.

FIG. 2 is an explanatory side view of the ice making machine. FIG. 3 is an explanatory view schematically showing a cross section of the ice making machine.

The ice making machine 1 is configured by a double-pipe ice making machine. The ice making machine 1 includes an evaporator 1A as a utilization-side heat exchanger, and a blade mechanism 15. The evaporator 1A includes an inner pipe 12 and an outer pipe 13 each formed in a cylindrical shape. The evaporator 1A is installed horizontally, and thus axes of the inner pipe 12 and the outer pipe 13 extend horizontally. The evaporator 1A of the present embodiment is configured by a flooded evaporator.

The inner pipe 12 is an element through which seawater as a medium to be cooled passes. The inner pipe 12 configures a cooling chamber that cools seawater. The inner pipe 12 is formed of a metal material. Both ends of the inner pipe 12 in an axial direction are closed.

An inflow port 16 for seawater is provided at one end of the inner pipe 12 in the axial direction (right side in FIG. 2). Seawater is supplied into the inner pipe 12 through the inflow port 16. A discharge port 17 for seawater is provided at the other end of the inner pipe 12 in the axial direction (left side in FIG. 2). The seawater in the inner pipe 12 is discharged through the discharge port 17.

The blade mechanism 15 is installed in the inner pipe 12. The blade mechanism 15 scrapes up the sherbet-like ice generated on an inner peripheral surface of the inner pipe 12 and disperses the ice inside the inner pipe 12.

The blade mechanism 15 includes a shaft 20, support bars 21, blades 22, and a drive unit 24. The other end of the shaft 20 in an axial direction extends outward from a flange 23 provided at the other end of the inner pipe 12 in the axial direction and is connected to a motor as the drive unit 24. The support bars 21 are erected at predetermined intervals on a peripheral surface of the shaft 20, and the blades 22 are attached to the tips of the support bars 21. Each of the blades 22 includes, for example, a resin or metal strip member. A side edge of the blade 22 on the front side in a rotation direction has a sharp tapered shape.

The outer pipe 13 is provided coaxially with the inner pipe 12 on a radially outer side of the inner pipe 12. The outer pipe 13 is formed of a metal material. One or a plurality of (in the present embodiment, three) refrigerant inlets 18 are provided at a lower part of the outer pipe 13. One or a plurality of (in the present embodiment, two) refrigerant outlets 19 are provided at an upper part of the outer pipe 13. Refrigerant that exchanges heat with seawater flows into an annular space 14 between an inner peripheral surface of the outer pipe 13 and an outer peripheral surface of the inner pipe 12. The refrigerant supplied through the refrigerant inlet 18 passes through the annular space 14 and is discharged through the refrigerant outlet 19.

As shown in FIG. 1, the ice making system A includes the control device 50. The control device 50 includes a CPU and a memory. The memory includes, for example, a RAM and a ROM.

The control device 50 realizes various controls regarding an operation of the ice making system A by the CPU executing a computer program stored in the memory. Specifically, the control device 50 controls the opening degrees of the utilization-side expansion valve 5 and the heat source-side expansion valve 27. The control device 50 also controls operating frequencies of the compressor 2 and the fan 10. The control device 50 further controls driving and stopping of the drive unit 24 of the blade mechanism 15 and the pump 9. The control device 50 may be provided separately on each of the ice making machine 1 and the heat source-side heat exchanger 3. In this case, for example, the control device on the heat source-side heat exchanger 3 can control operations of the heat source-side expansion valve 27, the fan 10, and the compressor 2, while the control device on the ice making machine 1 can control operations of the utilization-side expansion valve 5, the drive unit 24, and the pump 9.

The ice making system A is provided with a plurality of sensors. As shown in FIG. 1, the inflow port 16 of the ice making machine 1 is provided with an inflow pressure sensor 36 that detects a pressure of seawater (and ice slurry) flowing into the inner pipe 12. The discharge port 17 of the ice making machine 1 is provided with a discharge pressure sensor 37 that detects a pressure of seawater (and ice slurry) discharged from the inner pipe 12. The drive unit 24 of the ice making machine 1 is provided with a current sensor 35 that detects a current value. Detection signals of these sensors are input to the control device 50 and used for various types of control.

<Operation of Ice Making System>

(Ice Making Operation)

Figure 4:
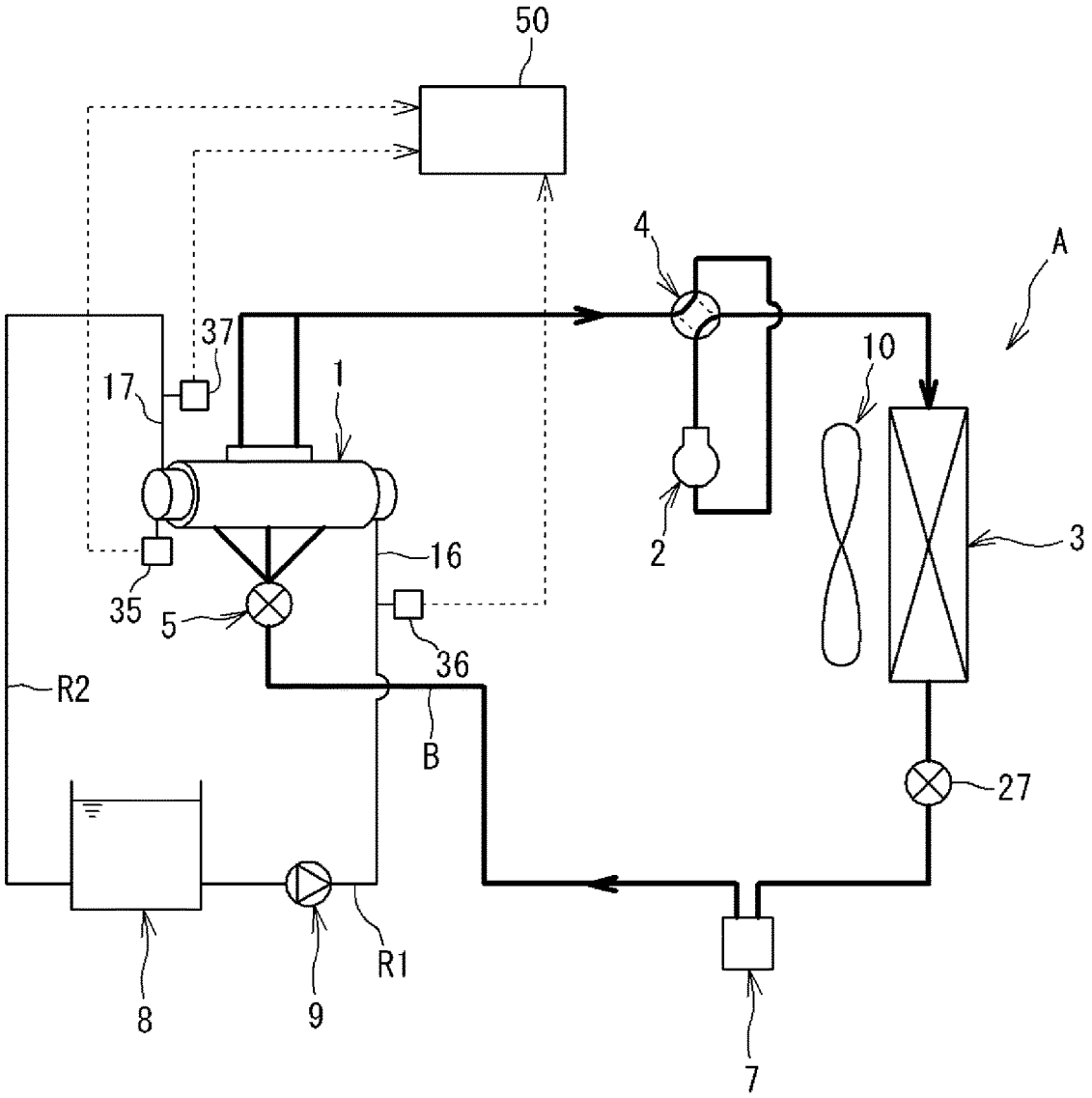
FIG. 4 is a schematic configuration diagram of the ice making system showing a flow of refrigerant during an ice making operation.

FIG. 4 is a schematic configuration diagram of the ice making system showing a flow of refrigerant during the ice making operation.

To perform a normal ice making operation, the four-way switching valve 4 is maintained in a state shown by the solid lines in FIG. 4. High-temperature, high-pressure gas refrigerant discharged from the compressor 2 flows through the four-way switching valve 4 into the heat source-side heat exchanger 3 functioning as a condenser, exchanges heat with air through activation of the fan 10, and is condensed and liquefied. The liquefied refrigerant flows through the fully opened heat source-side expansion valve 27 and then through the receiver 7, into the utilization-side expansion valve 5.

The refrigerant is decompressed to have a predetermined low pressure by the utilization-side expansion valve 5, becomes gas-liquid two-phase refrigerant, and is supplied through the refrigerant inlet 18 (see FIG. 2) of the ice making machine 1 into the annular space 14 between the inner pipe 12 and the outer pipe 13 that configure the ice making machine 1. The refrigerant supplied into the annular space 14 exchanges heat with seawater that has flowed into the inner pipe 12 through the pump 9, and evaporates. The refrigerant that has evaporated in the ice making machine 1 is sucked into the compressor 2.

The pump 9 sucks seawater from the seawater tank 8 and pumps the seawater into the inner pipe 12 of the ice making machine 1. The ice slurry generated in the inner pipe 12 is returned to the seawater tank 8 together with the seawater by a pump pressure. The ice slurry returned to the seawater tank 8 rises by buoyancy inside the seawater tank 8 and is accumulated in an upper part of the seawater tank 8.

(De-Icing Operation)

As a result of the ice making operation described above, a phenomenon (ice lock) may occur in which ice gathers and adheres in the inner pipe 12, and the blade 22 of the blade mechanism 15 is caught by the ice, thus increasing a rotational load, and a phenomenon (ice accumulation) may occur in which the flow of seawater in the inner pipe 12 of the ice making machine 1 is interrupted and ice slurry accumulates in the inner pipe 12. These make it difficult to continue to operate the ice making machine 1. In this case, the de-icing operation (cleaning operation) is performed to melt the ice inside the inner pipe 12.

Hereinafter, a procedure of shifting from the ice making operation to the de-icing operation and a procedure of the de-icing operation will be described with reference to flowcharts shown in FIGS. 6 and 7.

Figure 6:
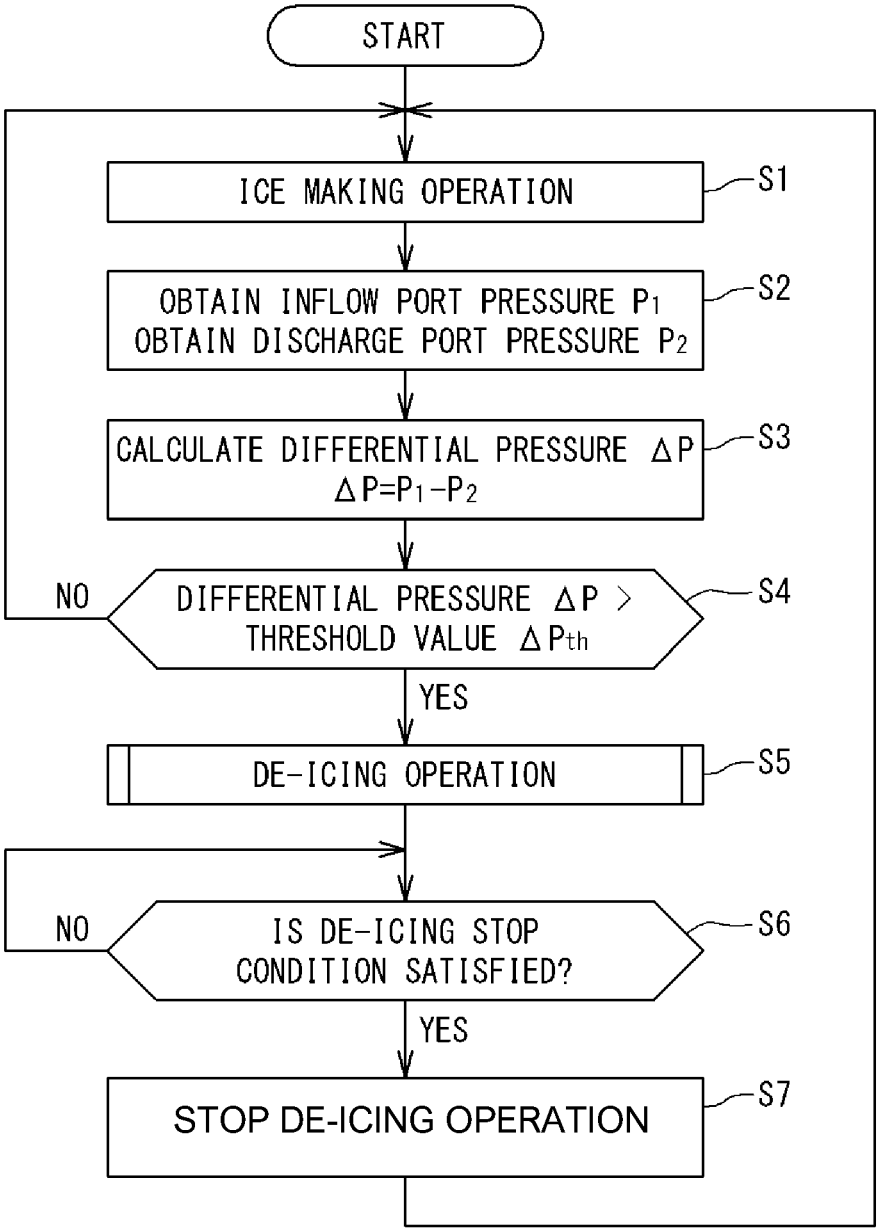
FIG. 6 is a flowchart showing a procedure of shifting from the ice making operation to the de-icing operation.

In FIG. 6, while the ice making system A is performing the ice making operation (step S1), the control device 50 constantly obtains the detection signals of the pressure sensors 36 and 37 (step S2). Then, the control device 50 calculates a differential pressure ΔP between the detection signal (pressure $P_1$) of the inflow pressure sensor 36 and the detection signal (pressure $P_2$) of the discharge pressure sensor 37 (step S3).

When the ice accumulation occurs in the inner pipe 12, the ice slurry is difficult to smoothly discharge from the discharge port 17, and a pressure difference between the pressure $P_1$ at the inflow port 16 and the pressure $P_2$ at the discharge port 17 increases. Therefore, the control device 50 compares the differential pressure ΔP between the pressure $P_1$ and the pressure $P_2$ with a predetermined threshold value ΔPth (step S4), and when the differential pressure ΔP exceeds the threshold value ΔPth, the control device 50 determines that the ice accumulation has occurred in the inner pipe 12. Then, the control device 50 starts the de-icing operation (step S5). As described above, by comparing the differential pressure ΔP between the inflow port 16 and the discharge port 17 of the inner pipe 12 with the predetermined threshold value ΔPth, it is possible to detect that the ice accumulation has occurred separately from the ice lock. The threshold value ΔPth can be set to, for example, about 0.03 MPa.

Hereinafter, the de-icing operation will be described.

Figure 7:
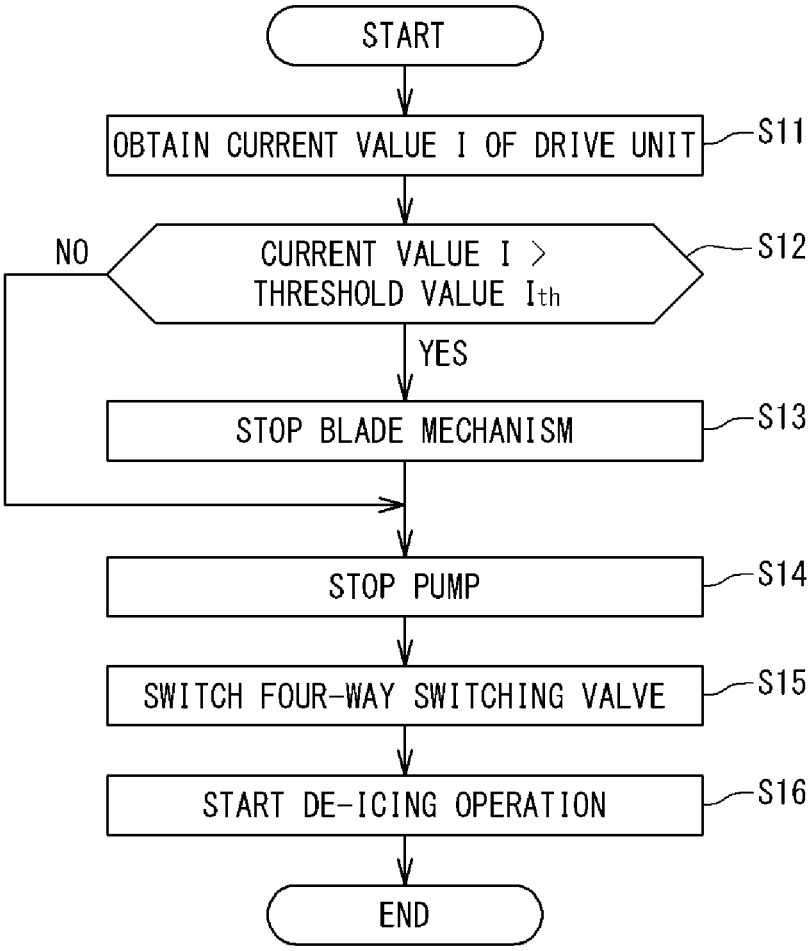
FIG. 7 is a flowchart showing a procedure of the de-icing operation.

In FIG. 7, the control device 50 obtains a current value I of the drive unit 24 in the blade mechanism 15 using the current sensor 35 (step S11). When the ice is clogged in the inner pipe 12 and a rotation resistance of the blade 22 increases, the current value I of the drive unit 24 increases. The control device 50 therefore compares the current value I with a predetermined threshold value Ith (step S12). When the current value I exceeds the threshold value Ith, the control device 50 stops the blade mechanism 15 (step S13). This can reduce a load on the blade mechanism 15 and suppress, for example, damage to the blade mechanism 15.

Conversely, when the current value I does not exceed the threshold value Ith, the blade mechanism 15 is continuously driven. This produces movement of the ice slurry clogged in the inner pipe 12 to promote the de-icing.

Then, the control device 50 stops the pump 9, and stops a circulation of seawater in the ice making machine 1 (step S14). This can suppress a rise in temperature inside the seawater tank 8, and suppress the melting of the ice accumulated in the seawater tank 8.

Then, the control device 50 switches the four-way switching valve 4 and reverses a flow of refrigerant during the ice making operation, thereby starting the de-icing operation (steps S15 and S16).

Figure 5:
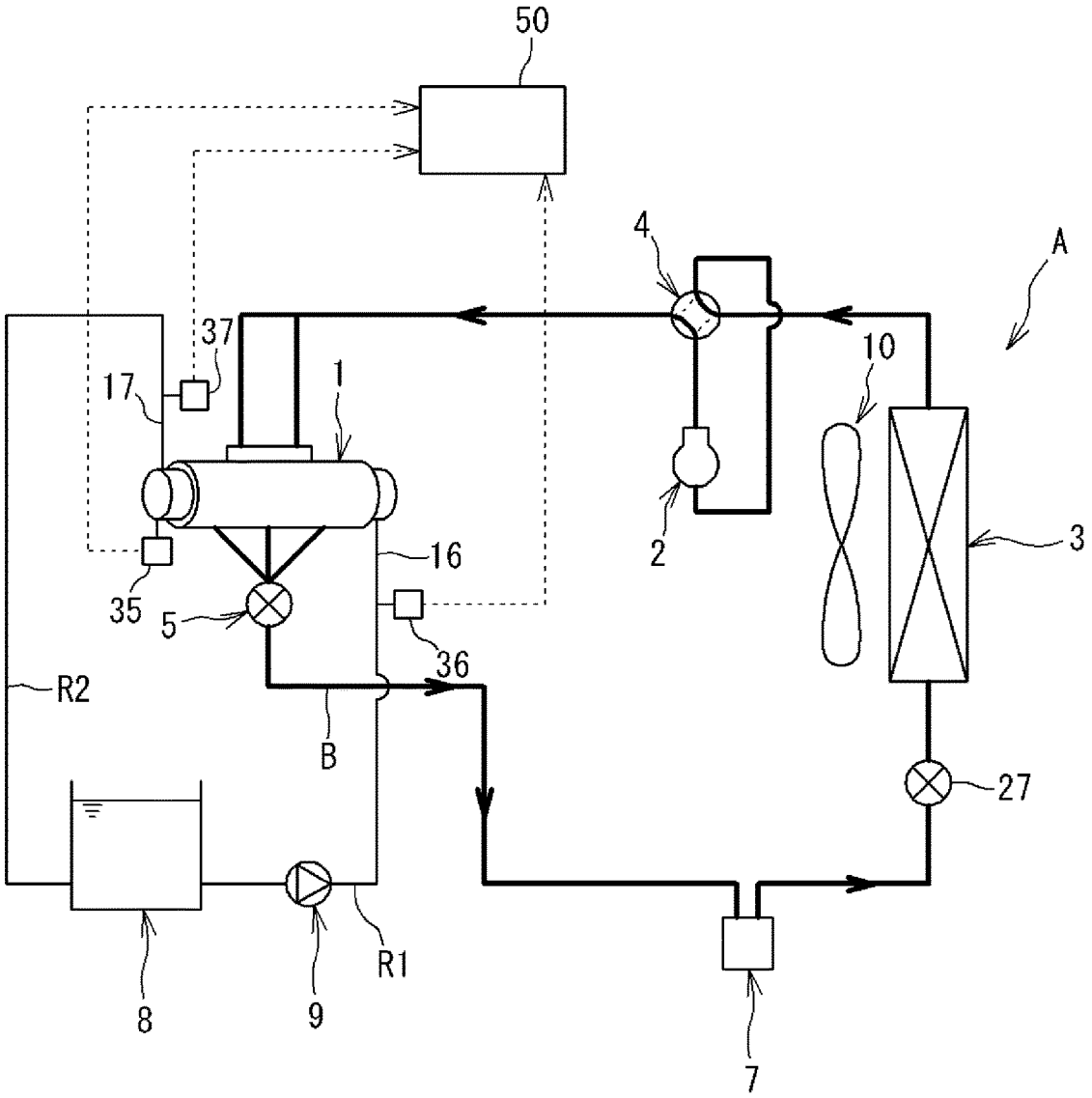
FIG. 5 is a schematic configuration diagram of the ice making system showing a flow of refrigerant during a de-icing operation.

FIG. 5 is a schematic configuration diagram of the ice making system showing a flow of refrigerant during the de-icing operation.

The control device 50 switches the four-way switching valve 4 to a state shown by the solid lines in FIG. 5. The high-temperature gas refrigerant discharged from the compressor 2 flows into the annular space 14 between the inner pipe 12 and the outer pipe 13 of the evaporator 1A via the four-way switching valve 4, exchanges heat with seawater including ice in the inner pipe 12, and is condensed and liquefied. At this time, the ice in the inner pipe 12 is heated by the refrigerant and melted. The liquid refrigerant discharged from the evaporator 1A passes through the fully opened utilization-side expansion valve 5, and flows into the heat source-side expansion valve 27 via the receiver 7. After being decompressed by the heat source-side expansion valve 27, the liquid refrigerant evaporates in the heat source-side heat exchanger 3 and is sucked into the compressor 2.

As shown in FIG. 6 again, the control device 50 determines whether a predetermined condition for stopping the de-icing operation is satisfied (step S6) and, if the stop condition is satisfied, stops the de-icing operation (step S7) and restarts the ice making operation (step S1). That is, the control device 50 switches the four-way switching valve 4 to a state shown by the solid lines in FIG. 4.

(Stop Conditions of De-Icing Operation)

An elapse of a predetermined time can be set as the stop condition of the de-icing operation. However, when the elapsed time until the stop is constant, the de-icing operation may be too short or too long depending on a state in the ice making machine 1 and a state in the seawater tank 8. When the de-icing operation is too short, ice nuclei in the seawater tank 8 are taken into the inner pipe 12 of the ice making machine 1 after the ice making operation is started, and ice is easily produced, which is likely to cause ice accumulation again. Further, when the de-icing operation is too long, there is a problem that the time required for making ice again becomes longer and the time during which ice cannot be used becomes longer.

In the present embodiment, in particular, the stop condition is set as follows in order to suppress the ice nuclei from being taken into the ice making machine 1 due to the de-icing operation being too short. Specifically, an elapse of time required for the ice crystals in the seawater tank 8 to rise to the upper part in the seawater tank 8 and not to be sucked again by the pump 9 can be set as the stop condition of the de-icing operation.

Normally, the ice crystals gather in the upper part of the seawater tank 8 to form a large lump, but in the lower part of the seawater tank 8, many small ice crystals sent from the ice making machine 1 are present. Since smaller ice crystals rise slowly, when de-icing time after switching from the ice making operation to the de-icing operation is too short, ice crystals that can turn into ice nuclei are taken into the ice making machine 1 by the pump 9 upon restart of the ice making operation, thereby causing the ice accumulation again. It is therefore possible to suppress the recurrence of the ice accumulation by setting the elapse of time until the ice crystals present in the lower part of the seawater tank 8 rise to the upper part of the seawater tank 8 as the stop condition of the de-icing operation.

A viscosity coefficient of the seawater (solution) is calculated from a salt concentration of the seawater in the seawater tank 8, and a terminal rise velocity (velocity when buoyancy=gravity+viscous resistance) is obtained in accordance with the viscosity coefficient. The time required for the ice crystals to rise (time required for stopping the de-icing operation) is calculated in accordance with the rise velocity, a height T2 of a pipe R2 for discharging the ice slurry from the ice making machine 1 into the seawater tank 8, a height T1 of a pipe R1 for sucking out seawater from the seawater tank 8, and the like. However, a minimum particle diameter (diameter) of the ice to be an ice nucleus at this time is about 400 μm.

It should be noted that the particle diameter and the rise velocity of the ice crystals in the seawater tank 8 may not be obtained by calculations but may be information obtained based on experiments or the like.

Further, the stop condition of the de-icing operation can be set as follows.

In the seawater tank 8, the ice may not be discharged from the seawater tank 8 due to sintering, and the ice may not be available to the user. In this case, an operation of heating the inside of the seawater tank 8 by activating the pump 9 during the de-icing operation (hereinafter, also referred to as "in-tank heating operation") can be performed to melt the sintered ice. When the in-tank heating operation is performed in parallel with the de-icing operation as described above, a termination of the in-tank heating operation can be set as the stop condition of the de-icing operation. This can suppress ice crystals in the seawater tank 8 from being taken into the ice making machine 1.

Second Embodiment

Figure 8:
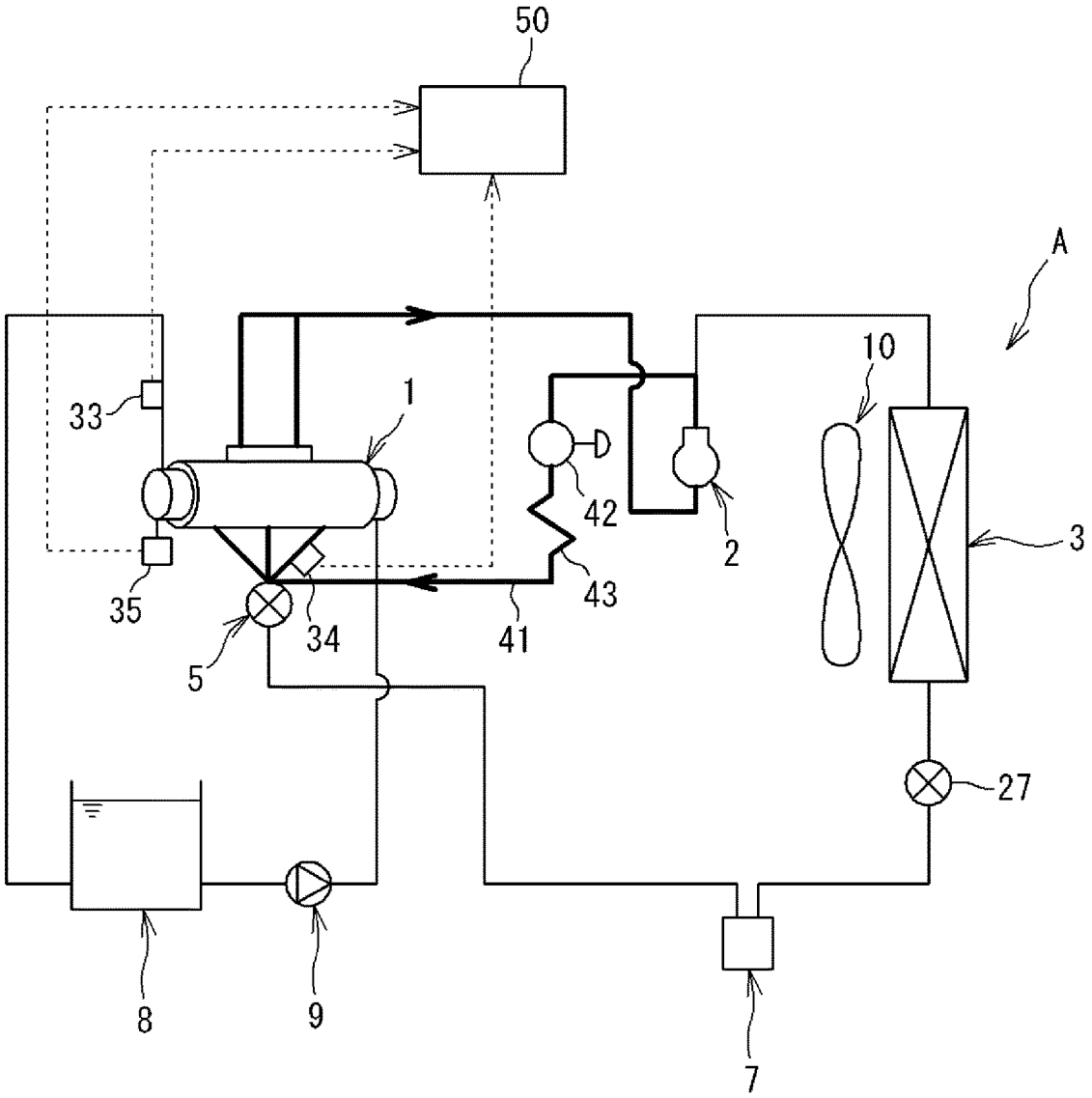
FIG. 8 is a schematic configuration diagram of an ice making system according to a second embodiment.

FIG. 8 is a schematic configuration diagram of an ice making system according to a second embodiment.

As in the first embodiment, a refrigerant circuit of the ice making system A of the second embodiment is configured by connecting, with a refrigerant pipe, the compressor 2, the heat source-side heat exchanger 3, the heat source-side expansion valve 27, the receiver 7, the utilization-side expansion valve 5, and the ice making machine 1 in that order.

As described above, a de-icing mechanism in the first embodiment is configured by the refrigerant circuit and the four-way switching valve 4 provided in the refrigerant circuit. The four-way switching valve 4 reverses the flow of the refrigerant during the ice making operation, whereby the de-icing operation is performed.

A de-icing mechanism of the present embodiment does not include a four-way switching valve like the one in the first embodiment, but includes a bypass refrigerant pipe 41, an on-off valve 42, and an expansion mechanism 43. One end of the bypass refrigerant pipe 41 is connected to a refrigerant pipe between the compressor 2 and the heat source-side heat exchanger 3. The other end of the bypass refrigerant pipe 41 is connected to a refrigerant pipe between the utilization-side expansion valve 5 and the ice making machine 1.

The on-off valve 42 is provided in the bypass refrigerant pipe 41, and is opened or closed to allow or block the flow of refrigerant in the bypass refrigerant pipe 41. The on-off valve 42 is opened and closed under the control of the control device 50. The on-off valve 42 is closed when the ice making operation is performed. The on-off valve 42 can be configured by an electromagnetic valve.

The expansion mechanism 43 decompresses the refrigerant flowing through the bypass refrigerant pipe 41 and lowers a temperature of the refrigerant. The expansion mechanism 43 is configured by a capillary tube. Alternatively, the expansion mechanism 43 may be configured by an expansion valve.

In the ice making system A of the present embodiment, the control device 50 closes the utilization-side expansion valve 5 and the heat source-side expansion valve 27 and opens the on-off valve 42 in order to perform the de-icing operation. As a result, the high-temperature, high-pressure gas refrigerant discharged from the compressor 2 does not flow to the heat source-side heat exchanger 3 but flows through the bypass refrigerant pipe 41 into the utilization-side heat exchanger 1A of the ice making machine 1. The gas refrigerant is decompressed by passing through the expansion mechanism 43 of the bypass refrigerant pipe 41, and becomes medium-temperature, low-pressure gas refrigerant.

In the utilization-side heat exchanger 1A, the gas refrigerant flows into the annular space 14 between the inner pipe 12 and the outer pipe 13, exchanges heat with seawater including ice in the inner pipe 12 to have a lower temperature, and becomes low-temperature, low-pressure gas refrigerant. At this time, the ice in the inner pipe 12 is heated by the refrigerant and melted. Then, the gas refrigerant is discharged from the utilization-side heat exchanger 1A and sucked into the compressor 2.

The ice making system A of the present embodiment does not require the four-way switching valve 4, thus simplifying the configuration of the refrigerant pipe. Since the utilization-side expansion valve 5 and the heat source-side expansion valve 27 are closed during the de-icing operation, it is not necessary to adjust the opening degree of each of the expansion valves 5 and 27, and the control device 50 can control the expansion valves 5 and 27 in a simplified manner.

Operation and Effect of Embodiments

As described above, the ice making system A according to the above embodiments includes the tank 8 that stores the medium to be cooled, the ice making machine 1 that cools the medium to be cooled and makes ice, the pump 9 that circulates the medium to be cooled between the tank 8 and the ice making machine 1, the de-icing mechanism (refrigerant circuit) that heats the medium to be cooled and melts the ice in the ice making machine 1, and the control device 50 that controls the operations of the ice making machine 1, the pump 9, and the de-icing mechanism. The ice making machine 1 includes the inner pipe 12 as a cooling chamber that cools the medium to be cooled, the inflow port 16 through which the medium to be cooled flows into the inner pipe 12, and the discharge port 17 through which the medium to be cooled is discharged from the inner pipe 12. The control device 50 activates the de-icing mechanism when the pressure difference between the pressure of the medium to be cooled at the inflow port 16 and the pressure of the medium to be cooled at the discharge port 17 exceeds a predetermined value.

This configuration makes it possible to detect that the ice accumulation has occurred in the ice making machine 1 and to perform the de-icing operation. The de-icing mechanism heats the cooling chamber, and thus the de-icing can be quickly performed.

The ice making machine 1 includes the inflow pressure sensor 36 that measures the pressure of the medium to be cooled at the inflow port 16 and the discharge pressure sensor 37 that measures the pressure of the cooling medium at the discharge port 17. The control device 50 calculates the pressure difference between the pressure detected by the inflow pressure sensor 36 and the pressure detected by the discharge pressure sensor 37, and compares the pressure difference with the predetermined value. With such a configuration, the de-icing mechanism can be activated based on the pressure difference between the inflow port 16 and the discharge port 17.

The control device 50 stops the pump 9 during the de-icing operation. This can suppress the melting of the ice in the seawater tank 8, which is caused by a temperature rise in the seawater tank 8.

The ice making machine 1 includes the blade mechanism 15 that rotates in the inner pipe 12 to disperse ice, and the current sensor 35 as a detector that detects a locked state of the blade mechanism 15. The control device 50 stops the blade mechanism 15 when the current sensor 35 detects the locked state of the blade mechanism 15 during the de-icing operation. This can suppress, for example, damage to the blade mechanism 15. When the blade mechanism 15 is not locked, the de-icing can be promoted by activating the blade mechanism 15 during the de-icing operation.

The ice making system A further includes the refrigerant circuit that is formed by connecting, with the refrigerant pipe, the compressor 2, the heat source-side heat exchanger 3, the heat source-side expansion valve 27 and the utilization-side expansion valve 5 as expansion mechanisms, and the utilization-side heat exchanger 1A in that order. The utilization-side heat exchanger 1A configures a part of the ice making machine, and exchanges heat with the medium to be cooled in the inner pipe 12 to evaporate the refrigerant during the ice making operation. The de-icing mechanism of the first embodiment includes the refrigerant circuit and the four-way switching valve 4. The four-way switching valve 4 is connected to the discharge side of the compressor 2 in the refrigerant circuit, and switches the ice making operation to the de-icing operation by switching a flow path of refrigerant discharged from the compressor 2, from a path leading to the heat source-side heat exchanger 3 to a path leading to the utilization-side heat exchanger 1A. In this manner, the de-icing operation can be performed using the refrigerant circuit in which the ice making machine 1 makes ice.

The control device 50 stops the de-icing operation when the time required for the ice crystals in the tank 8 to rise to a height at which the ice crystals in the tank 8 are not discharged toward the ice making machine 1 has elapsed by the activation of the pump 9. Thus, when the ice making system A returns from the de-icing operation to the ice making operation, the ice crystals in the seawater tank 8 are not sent to the ice making machine 1. This can suppress the recurrence of the ice accumulation in the ice making machine 1.

Other Modifications

The present disclosure is not limited to the embodiments described above, but various modifications can be made within the scope of the claims.

For example, in the procedure of the de-icing operation shown in FIG. 7, the de-icing operation that originally starts in step S15 may alternatively start before step S13, or may start between step S13 and step S14.

For example, in the above embodiments, the double-pipe ice making machine is used, but the present disclosure is not limited to this type of ice making machine. The de-icing mechanism may alternatively be an electric heater or a hot-water (or normal-temperature water) heater, for example, that heats the inner pipe (cooling chamber) 12 of the ice making machine 1 from the outside.

The receiver may be omitted in the refrigerant circuit. In this case, only one expansion valve as an expansion mechanism may be provided in a liquid-side refrigerant pipe between the heat source-side heat exchanger and the utilization-side heat exchanger.

The medium to be cooled is not limited to seawater, but may be another solution such as ethylene glycol.

There is provided one ice making machine in the above embodiments, but a plurality of ice making machines may be connected in series. There is provided one compressor in the above embodiments, but a plurality of compressors may be connected in parallel.

What is claimed is:

1. An ice making system comprising:
a tank that stores a medium to be cooled;
an ice making machine that cools the medium to be cooled and makes ice;
a pump that circulates the medium to be cooled between the tank and the ice making machine;
a de-icing mechanism that performs a de-icing operation of heating the medium to be cooled and melting the ice in the ice making machine; and
a controller configured to control operations of the ice making machine, the pump, and the de-icing mechanism,
the ice making machine including
a cooling chamber that cools the medium to be cooled,
an inflow port through which the medium to be cooled flows into the cooling chamber,
a discharge port through which the medium to be cooled is discharged from the cooling chamber,
a blade mechanism that rotates in the cooling chamber to disperse ice, and
a detector that detects a locked state of the blade mechanism,
the controller being configured to activate the de-icing mechanism when a pressure difference between a pressure of the medium to be cooled at the inflow port and a pressure of the medium to be cooled at the discharge port exceeds a predetermined value, and
in shifting to a de-icing operation or during the de-icing operation, the controller being further configured to
allow the blade mechanism to continue operating when the detector does not detect the locked state of the blade mechanism, and
stop the blade mechanism when the detector detects the locked state.

2. The ice making system according to claim 1, wherein the controller is further configured to stop the pump during the de-icing operation.

3. The ice making system according to claim 2, wherein the ice making machine further includes
an inflow pressure sensor that detects a pressure of the medium to be cooled at the inflow port, and
a discharge pressure sensor that detects a pressure of the medium to be cooled at the discharge port, and
the controller is further configured to
calculate a pressure difference between the pressure detected by the inflow pressure sensor and the pressure detected by the discharge pressure sensor, and
compare the pressure difference with the predetermined value.

4. The ice making system according to claim 3, further comprising:
a refrigerant circuit formed by connecting a compressor, a heat source-side heat exchanger, an expansion valve, and a utilization-side heat exchanger in order with refrigerant pipe,
the utilization-side heat exchanger
forming a part of the ice making machine, and
exchanging heat with the medium to be cooled in the cooling chamber to evaporate refrigerant during an ice making operation,
the de-icing mechanism including the refrigerant circuit and a four-way switching valve connected to a discharge side of the compressor in the refrigerant circuit, and
the four-way switching valve being configured to switch the ice making operation to the de-icing operation by switching a flow path of refrigerant discharged from the compressor
from a path leading to the heat source-side heat exchanger
to a path leading to the utilization-side heat exchanger.

5. The ice making system according to claim 2, further comprising:
a refrigerant circuit formed by connecting a compressor, a heat source-side heat exchanger, an expansion valve, and a utilization-side heat exchanger in order with refrigerant pipe,
the utilization-side heat exchanger
forming a part of the ice making machine, and
exchanging heat with the medium to be cooled in the cooling chamber to evaporate refrigerant during an ice making operation,
the de-icing mechanism including the refrigerant circuit and a four-way switching valve connected to a discharge side of the compressor in the refrigerant circuit, and
the four-way switching valve being configured to switch the ice making operation to the de-icing operation by switching a flow path of refrigerant discharged from the compressor
from a path leading to the heat source-side heat exchanger
to a path leading to the utilization-side heat exchanger.

6. The ice making system according to claim 1, wherein the ice making machine further includes
an inflow pressure sensor that detects a pressure of the medium to be cooled at the inflow port, and
a discharge pressure sensor that detects a pressure of the medium to be cooled at the discharge port, and
the controller is further configured to
calculate a pressure difference between the pressure detected by the inflow pressure sensor and the pressure detected by the discharge pressure sensor, and
compare the pressure difference with the predetermined value.

7. The ice making system according to claim 6, further comprising:

a refrigerant circuit formed by connecting a compressor, a heat source-side heat exchanger, an expansion valve, and a utilization-side heat exchanger in order with refrigerant pipe, the utilization-side heat exchanger forming a part of the ice making machine, and exchanging heat with the medium to be cooled in the cooling chamber to evaporate refrigerant during an ice making operation, the de-icing mechanism including the refrigerant circuit and a four-way switching valve connected to a discharge side of the compressor in the refrigerant circuit, and the four-way switching valve being configured to switch the ice making operation to the de-icing operation by switching a flow path of refrigerant discharged from the compressor from a path leading to the heat source-side heat exchanger to a path leading to the utilization-side heat exchanger.

8. The ice making system according to claim 1, further comprising:

a refrigerant circuit formed by connecting a compressor, a heat source-side heat exchanger, an expansion valve, and a utilization-side heat exchanger in order with refrigerant pipe, the utilization-side heat exchanger forming a part of the ice making machine, and exchanging heat with the medium to be cooled in the cooling chamber to evaporate refrigerant during an ice making operation, the de-icing mechanism including the refrigerant circuit and a four-way switching valve connected to a discharge side of the compressor in the refrigerant circuit, and the four-way switching valve being configured to switch the ice making operation to the de-icing operation by switching a flow path of refrigerant discharged from the compressor from a path leading to the heat source-side heat exchanger to a path leading to the utilization-side heat exchanger.

9. An ice making system comprising:

a tank that stores a medium to be cooled;

an ice making machine that cools the medium to be cooled and makes ice;

a pump that circulates the medium to be cooled between the tank and the ice making machine;

a de-icing mechanism that performs a de-icing operation of heating the medium to be cooled and melting the ice in the ice making machine; and a controller configured to control operations of the ice making machine, the pump, and the de-icing mechanism, the ice making machine including a cooling chamber that cools the medium to be cooled, an inflow port through which the medium to be cooled flows into the cooling chamber, and a discharge port through which the medium to be cooled is discharged from the cooling chamber, and the controller being configured to activate the de-icing mechanism when a pressure difference between a pressure of the medium to be cooled at the inflow port and a pressure of the medium to be cooled at the discharge port exceeds a predetermined value, the controller being configured to stop the pump during the de-icing operation, and the controller being further configured to stop the de-icing operation when time required for ice crystals that have flowed into the tank through an ice making operation to rise to a height (A) has elapsed, the height (A) being a height at which the ice crystals in the tank are not discharged toward the ice making machine even if the pump that has stopped for the de-icing operation reoperates.

10. The ice making system according to claim 9, wherein the ice making machine further includes an inflow pressure sensor that detects a pressure of the medium to be cooled at the inflow port, and a discharge pressure sensor that detects a pressure of the medium to be cooled at the discharge port, and the controller is further configured to calculate a pressure difference between the pressure detected by the inflow pressure sensor and the pressure detected by the discharge pressure sensor, and compare the pressure difference with the predetermined value.

11. The ice making system according to claim 10, further comprising:

a refrigerant circuit formed by connecting a compressor, a heat source-side heat exchanger, an expansion valve, and a utilization-side heat exchanger in order with refrigerant pipe, the utilization-side heat exchanger forming a part of the ice making machine, and exchanging heat with the medium to be cooled in the cooling chamber to evaporate refrigerant during an ice making operation, the de-icing mechanism including the refrigerant circuit and a four-way switching valve connected to a discharge side of the compressor in the refrigerant circuit, and the four-way switching valve being configured to switch the ice making operation to the de-icing operation by switching a flow path of refrigerant discharged from the compressor from a path leading to the heat source-side heat exchanger to a path leading to the utilization-side heat exchanger.

12. The ice making system according to claim 9, further comprising:

a refrigerant circuit formed by connecting a compressor, a heat source-side heat exchanger, an expansion valve, and a utilization-side heat exchanger in order with refrigerant pipe, the utilization-side heat exchanger forming a part of the ice making machine, and exchanging heat with the medium to be cooled in the cooling chamber to evaporate refrigerant during an ice making operation, the de-icing mechanism including the refrigerant circuit and a four-way switching valve connected to a discharge side of the compressor in the refrigerant circuit, and the four-way switching valve being configured to switch the ice making operation to the de-icing operation by switching a flow path of refrigerant discharged from the compressor from a path leading to the heat source-side heat exchanger to a path leading to the utilization-side heat exchanger.

* * * * *